US005464202A

United States Patent [19]

Capdeboscq

[11] Patent Number: 5,464,202

[45] Date of Patent: Nov. 7, 1995

[54] APPARATUS AND METHOD FOR FEEDING SHEETS FROM A STACK

[75] Inventor: Bernard Capdeboscq, St. Just-Chaleyssin, France

[73] Assignee: SA Martin, Villeurbanne, France

[21] Appl. No.: 285,099

[22] Filed: Aug. 3, 1994

[30] Foreign Application Priority Data

Aug. 5, 1993 [FR] France ..... 93 09840

[51] Int. Cl.[6] ..... B65H 5/08

[52] U.S. Cl. ..... 271/11; 271/35; 271/99; 271/112; 271/118; 271/10.04

[58] Field of Search ..... 271/10, 11, 35, 271/105, 99, 112, 114, 118; 414/797.5, 757.6

[56] References Cited

U.S. PATENT DOCUMENTS

| | | | |
|---|---|---|---|
| 4,045,015 | 8/1977 | Sardella | 271/114 X |
| 4,896,872 | 1/1990 | Sardella | 271/112 X |
| 5,026,040 | 6/1991 | Gilbert | 271/112 X |
| 5,048,812 | 9/1991 | Holmes | 271/11 |
| 5,050,852 | 9/1991 | Sawada et al. | 271/112 X |
| 5,184,811 | 2/1993 | Sardella et al. | 271/114 X |
| 5,219,157 | 6/1993 | Takahashi | 271/118 X |
| 5,228,674 | 7/1993 | Holmes | 271/112 X |

FOREIGN PATENT DOCUMENTS

| | | |
|---|---|---|
| 0183361 | 6/1986 | European Pat. Off. . |
| 0379306 | 7/1990 | European Pat. Off. . |

*Primary Examiner*—William E. Terrell
*Assistant Examiner*—Carol L. Druzrick
*Attorney, Agent, or Firm*—Hill, Steadman & Simpson

[57] ABSTRACT

In a system and method for feeding sheets from a stack, a support arrangement is provided having a plurality of rows of rollers mounted on support levers to support the stack above a first carrier. The rollers are lowered so that a lowermost sheet of the stack contacts the first carrier which is driven to cyclically accelerate the lowermost sheet in a direction perpendicular to the rows so that the sheet achieves a linear velocity. A second carrier is driven at a constant speed to transport the sheet away from the first carrier at the linear velocity. Each row of rollers is sequentially raised when a trailing edge of the sheet has moved beyond that particular row.

16 Claims, 6 Drawing Sheets

APPARATUS AND METHOD FOR FEEDING SHEETS FROM A STACK

BACKGROUND OF THE INVENTION

The present invention relates generally to an apparatus and method for dispensing sheets. More particularly, the present invention relates to a system and method for removing individual sheets from a stack and feeding the sheets to processing equipment.

Devices for feeding sheets of material are known. For instance, in the box making industry, stacks of corrugated cardboard sheets are fed to a processing line for making boxes. In a box making plant, such subsequent equipment is typically provided for printing, cutting slots, and folding corrugated cardboard sheets which travel down the line. Devices are known for continually removing individual cardboard sheets from such a stack, and for feeding those sheets to a line of subsequent processing equipment.

Box-making equipment is generally configured to process sheets at a particular rate. Therefore, it is important that a sheet-feeding device feeds a supply of corrugated cardboard sheets at the same rate that the other equipment operates. Feeding sheets with imprecise timing can result in a malfunction of a subsequent box making step. Therefore, it is desirable to provide a sheet feeding apparatus that can continually remove sheets from a stack at a precise rate and for transferring the sheets to a manufacturing line in a precise sequence and speed.

U.S. Pat. No. 5,048,812 discloses a prior art sheet feeding apparatus. That device includes a holder for storing a horizontal stack of cardboard sheets. A gate is provided at a front side of the holder so that the lowermost sheet of the stack can fit between a bottom edge of the gate and a series of rollers located beneath the holder.

In the system described in that patent, a first series of rollers are provided which are driven at a variable velocity, capable of accelerating a sheet from a linear speed of zero to a speed corresponding to the required linear sheet speed of the subsequent box-processing equipment in an assembly line. A second series of rollers operates at a constant velocity corresponding to the required linear sheet speed and immediately follows the first series.

In the prior art device, a stack lowering mechanism is provided which has a plurality of cam-driven reciprocating lifting pads. The lifting pads are used for movably supporting the stack, which can be lowered to place the lowermost sheet into contact with the rollers of the first series. Upon contact with the rollers, the lowermost sheet is transported away from the stack. As the sheet is transported away from the stack, the lifting pads are sequentially actuated upward by the cams, to hold the remaining stack out of contact with the first series of rollers.

The sequential actuation of the lifting pads in the prior art device corresponds to the position of the leading edge of a sheet being removed. More particularly, the prior art sheet feeder, as the leading edge of a sheet contacts a first roller of the second series, the rearmost lifting pads are actuated upward into contact with the stack. Similarly, as the leading edge of the sheet contacts a second roller of the second series, the next rearmost lifting pads are actuated upward into contact with the stack, and so on.

A problem with the prior art sheet feeder lies in the fact that the lifting pads can be actuated upward into the travelling sheet. When this happens, the traveling sheet becomes rubbed between the lifting pads and weight of the remaining stack which is in the holder. This rubbing effect continues until the trailing edge of the removed sheet has been pulled clear of the forwardmost lifting pad, making the process less efficient and accurate. The described problem is particularly apparent when the sheets are long.

Therefore, a need exists for an improved sheet feeding apparatus with a stack lifting means which does not rub a sheet being pulled from a stack.

SUMMARY OF THE INVENTION

The present invention overcomes the deficiencies of prior art sheet feeders. Particularly, the invention provides a sheet feeding apparatus which upwardly supports a stack of sheets on lifting members which are sequentially raised corresponding to a position of a trailing edge of a sheet being moved. To this end, the present invention provides an apparatus and method of feeding a sheet from a stack where the lowermost sheet of the stack is supported on a plurality of rows of rollers. The rollers are lowered so that a lowermost sheet of the stack contacts a first carrier. The first carrier is driven to accelerate the lowermost sheet in a direction perpendicular to the rows so that the sheet achieves a linear velocity. A second carrier, which immediately follows the first carrier, is driven at a constant speed to transport the sheet away from the first carrier at the linear velocity. Each row of rollers is sequentially raised when a trailing edge of the sheet has moved beyond that particular row.

The first carrier is driven in a repeating cycle from a corresponding linear speed of zero to the corresponding linear speed and back to zero. A locking device engages to temporarily retain each row of the rollers in a raised position. The locking device is then disengaged to lower the rollers simultaneously.

In order to carry out the above described method, the present invention also provides an apparatus for feeding a sheet from a stack. A first carrier is positioned under the stack for transporting the sheet in a direction. The first carrier is driveable at variable speeds. A second carrier for transporting the sheet is driveable at a constant speed and is positioned to receive a sheet transported by the first carrier. A plurality of rows of rollers are operable to raise and lower the stack onto the first carrier. The rows are arranged transversely to the direction. A means for raising and lowering the rows of rollers is provided such that each row of rollers is sequentially raised to support the stack when a trailing edge of the sheet moves beyond each row of rollers.

The means for raising and lowering includes a plurality of support levers. Each support lever has at least one of the rollers mounted thereon. A plurality of shafts are provided on which the support levers are mounted such that one of the shafts is associated with each of the rows of rollers.

In an embodiment, the means for raising and lowering further includes a rotatable endless belt. A ramped shoe or cam is secured to the belt. A plurality of actuation levers are provided such that at least one actuation lever is operably connected to each of the rows of rollers. The shoe contacts each support lever to cause an upward movement of the rollers.

In another embodiment, the means for raising and lowering includes: a plurality of rotatable cams so that one cam is associated with each row of rollers; a plurality of follower levers is provided so that one of the follower levers is operably connected to each shaft; and each follower lever follows a one cam at the respective row to cause the rollers to move upward.

The first carrier preferably is at least one endless belt and may include a plurality of side-by-side endless belts. A drive pulley and idler pulley are associated with each belt. The rollers are configured to raise and lower between the belts.

An advantage of the present invention is that it provides an apparatus and method for feeding sheets from a stack with greatly improved continuity and accuracy.

Another advantage of the present invention is that it provides an apparatus and method for feeding sheets to a processing line without rubbing the upper side of a lifting member during the movement of that sheet.

A further advantage of the present invention is that the weight of the stack is supported while a lowermost sheet is removed from the stack.

An additional advantage of the present invention is that the rubbing and thus frictional forces are reduced between the lowermost sheet being removed and the remaining stack.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
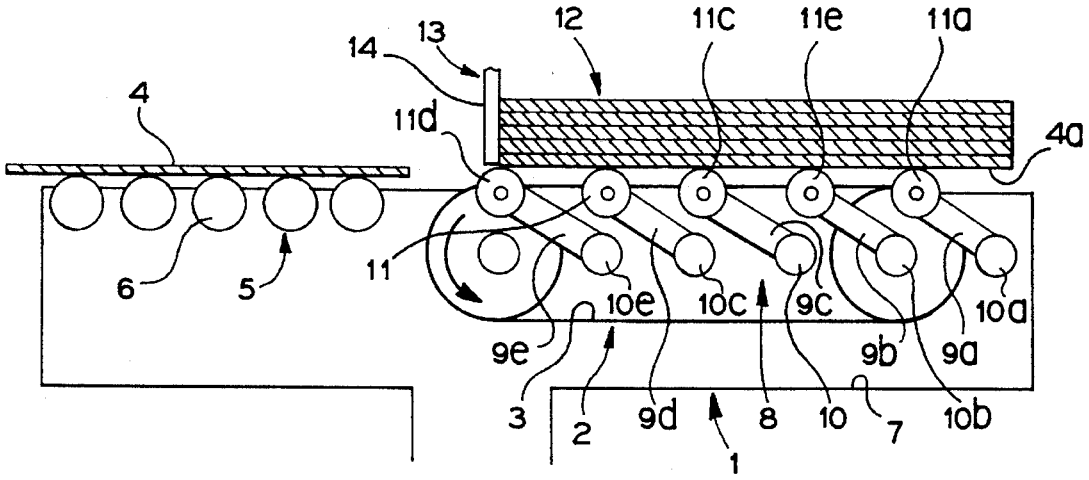
FIGS. 1–6 are diagrammatic side views of an apparatus for feeding sheets according to the present invention which views illustrate sequential points during operation of the apparatus.

The sheet feeding apparatus 1 which illustrates the present invention is generally indicated at FIGS. 1–6, which illustrates various stages of operation of the apparatus. The apparatus 1 is configured to receive a stack 12 of sheets 4, such as sheets of cardboard, paper, or other sheet materials.

The sheet feeding apparatus 1 is particularly useful for continually feeding of sheets of material such as corrugated cardboard from a supply stack to a processing line of other equipment, such as that for manufacturing boxes. Such processing equipment is not shown, and is not the focus the invention, but would be located to the left of the apparatus 1 in FIGS. 1–6.

The processing equipment to which sheets are fed could consist of machinery for printing on the sheets, cutting slots, applying glue, etc. Such equipment is arranged to process sheets at a particular rate; therefore, the feeding apparatus 1 must continually and repeatedly dispense individual sheets from the stack to the processing line at the same rate, and at the same linear speed as the subsequent equipment is designed to process a sheet.

The sheet feeding apparatus 1 has a first carrier 2. The first carrier 2 has a plurality of endless conveyor belts 3 (See FIG. 9) which are driveable at variable speeds in a repeated cycle. The cycle varies the belts 3 from a linear belt speed of zero to a linear belt speed corresponding to the processing machinery (not shown).

The first carrier 2 is followed by a second carrier 5 (FIG. 1). As shown, the second carrier 5 is a plurality of rollers 6. During operation the rollers 6 are continuously driven at a speed which will carry a sheet at a linear speed desired for feeding into a subsequent processing machine.

As shown, the first carrier 2 and the second carrier 5 are positioned within a vacuum housing 7. However, in another embodiment, only the first carrier 2 is located in the vacuum housing 7, and the second carrier 5 is not.

Operable with the first carrier 2, is a stack supporting means 8. The stack supporting means 8 includes a plurality of stack support levers **9*a*–9*e*, each of which is secured at one end to a respective transverse shaft 10*a*–10*e*. The other end of each lever 9*a*–9*e* has an respective stack supporting roller 11*a*–11*e*. Each shaft 10*a*–10*e* is fitted with a series of respective support levers 9*a*–9*e*. In a particular series of support levers, e.g. levers 9*a* secured to shaft 10*a* or levers 9*b* secured to shaft 10*b*, the levers 9 are spaced along the respective shaft at positions between the multiple belts 3 (see FIG. 9**).

A stack 12 of sheets 4 (FIG. 4) is placed in a holder 13 which is disposed above the first carrier 2. The holder includes a front wall or gate 14 which is vertically adjustable so that one sheet can pass between a lower edge of the gate 14 and the belts 3.

FIG. 1 illustrates the apparatus 1 at the end of a sheet feeding cycle. The rollers **11*a*–11*e* are in an upward position, raising the stack 12 so that its lowermost sheet 4*a* is not in contact with the belts 3. The first carrier 2 is in a slowing-down phase, decelerating the belts 3** to a linear speed of approximately zero.

For clarity in illustrating the invention, FIGS. 2–6 do not show the vacuum housing 7, and FIGS. 3–6 do not show the second carrier 5.

Figure 2:
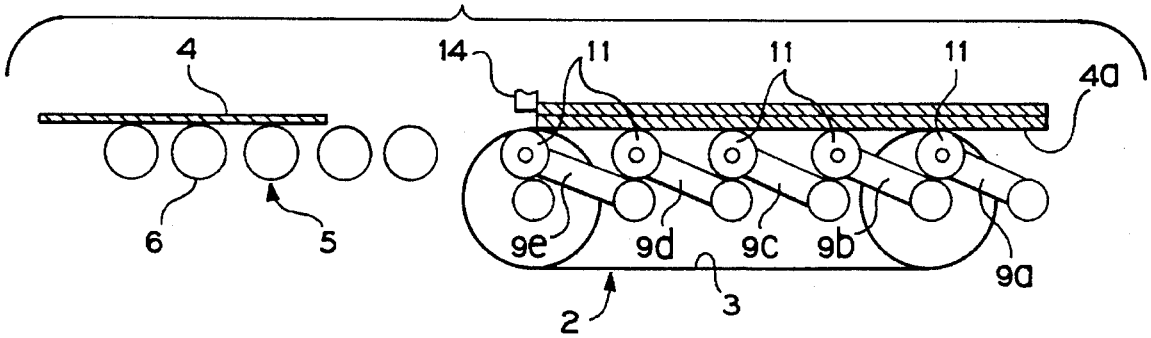

In the stage illustrated in FIG. 2, the belts 3 of the first carrier 2 are at a standstill. The shafts 10 (see also FIG. 9) have been released and the stack supporting levers **9*a*–9*e* of the stack supporting means 8 having been moved to a downward or retracted position. Each stack supporting lever 9*a*–9*e* is biased to the downward position shown in FIG. 2 by an associated spring 15 (see FIGS. 7 and 8). The stack supporting rollers 11*a*–11*e* are thereby retracted below an upper plane of the belts 3. Therefore, the lowermost sheet 4*a* of the stack is in contact with the belts 3, and has zero linear speed. At the left of FIG. 2, a sheet 4 which has already been dispensed is traveling along the constant speed rollers 6** toward subsequent processing equipment at a linear speed which such processing equipment requires.

Figure 3:
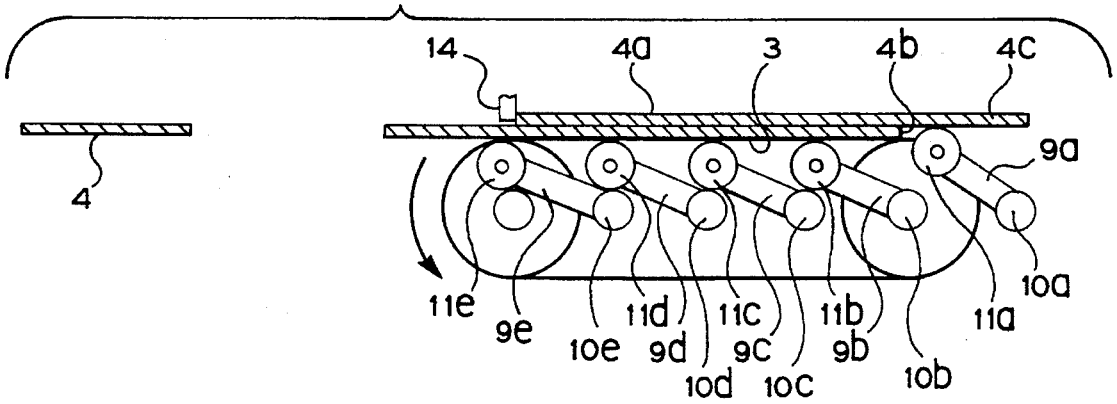

At the point illustrated in FIG. 3, the belts 3 of the first carrier 2 are accelerated from zero linear speed to the linear speed corresponding to the second carrier 5. Consequently, the lowermost sheet of the stack 12 travels under the front wall or gate 14 of the holder 13. After a trailing edge **4*b* of the sheet 4*a* has traveled past the rearmost sheet supporting roller 11*a*, a support actuator 16 (see FIGS. 7 and 8) operates to pivot the rear most shaft 10*a*, resulting in an upward movement of the rear most roller 11*a* to contact the next sheet, sheet 4*c*, supporting the stack 12. No rubbing occurs between the roller 11*a* and the sheet 4*a*. The means of actuating the stack supporting means 8 is described in greater detail below, in relation to FIGS. 7 and 8**.

Figure 4:
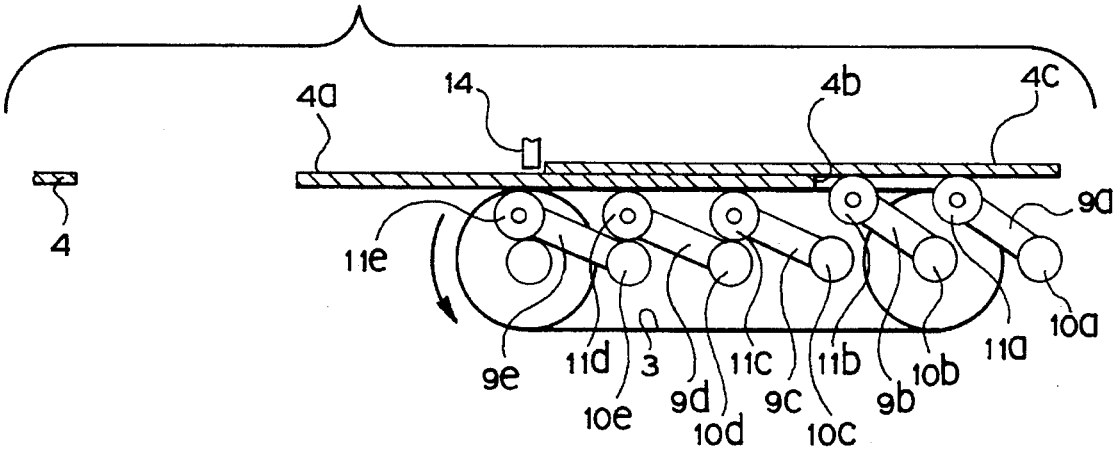

In the stage of operation illustrated in FIG. 4, sheet **4*a* continues forward motion, as driven by the belts 3. As its trailing edge 4*b* travels clear of sheet supporting roller 11*b*, the sheet supporting roller 11***b* is also actuated upward to contact the next sheet in the stack, sheet 4*c*, to support the stack. Like roller 11*a*, no rubbing occurs between roller 11*b* and the sheet 4*a* being fed.

Figure 5:
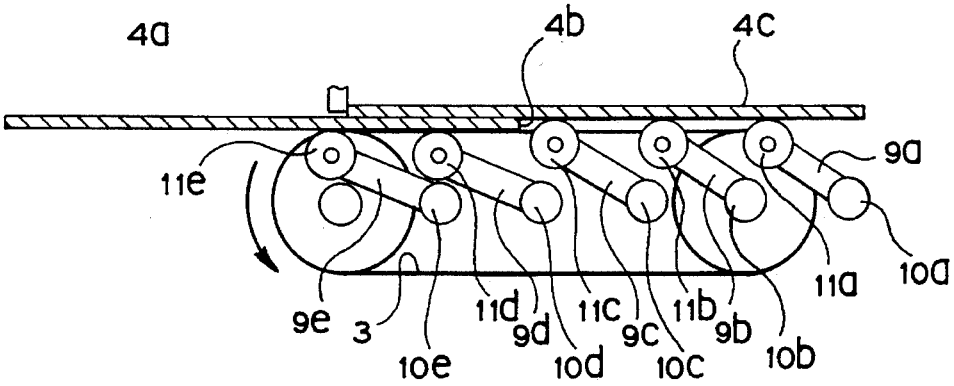

Similarly, FIG. 5 illustrates sheet 4*a* moving forward such that its trailing edge 4*b* travels clear of sheet supporting roller 11*c*. At this time, sheet supporting roller 11*c* is actuated upward into sheet 4*c*, supporting the stack 12.

Figure 6:
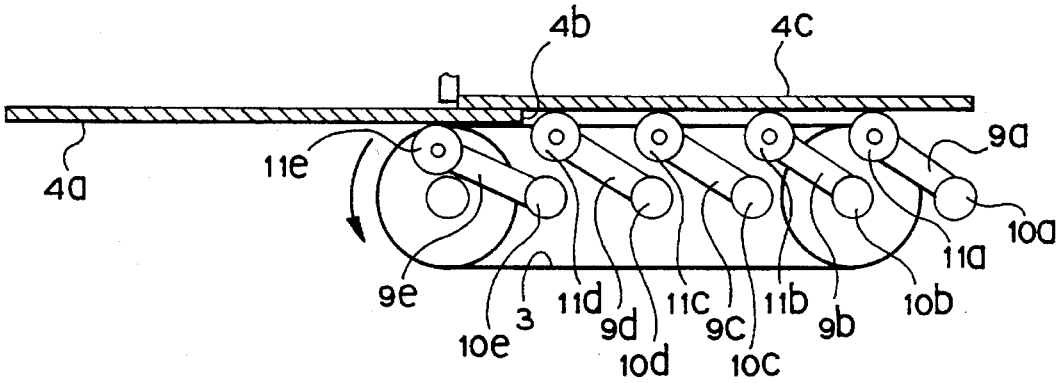

FIG. 6 illustrates the trailing edge 4*b* moved clear of sheet supporting roller 11*d*, at which point sheet supporting 11*d* is actuated upward into contact with sheet 4*c*. Similarly, sheet supporting lever 11*e* is lifted after the trailing edge 4*b* has traveled clear. The sheet is then completely on the second carrier 5 moving or traveling at a constant velocity. At that point, the stage of operation is as illustrated in FIG. 1. This described cycle continually repeats at a selected rate.

Figure 7:
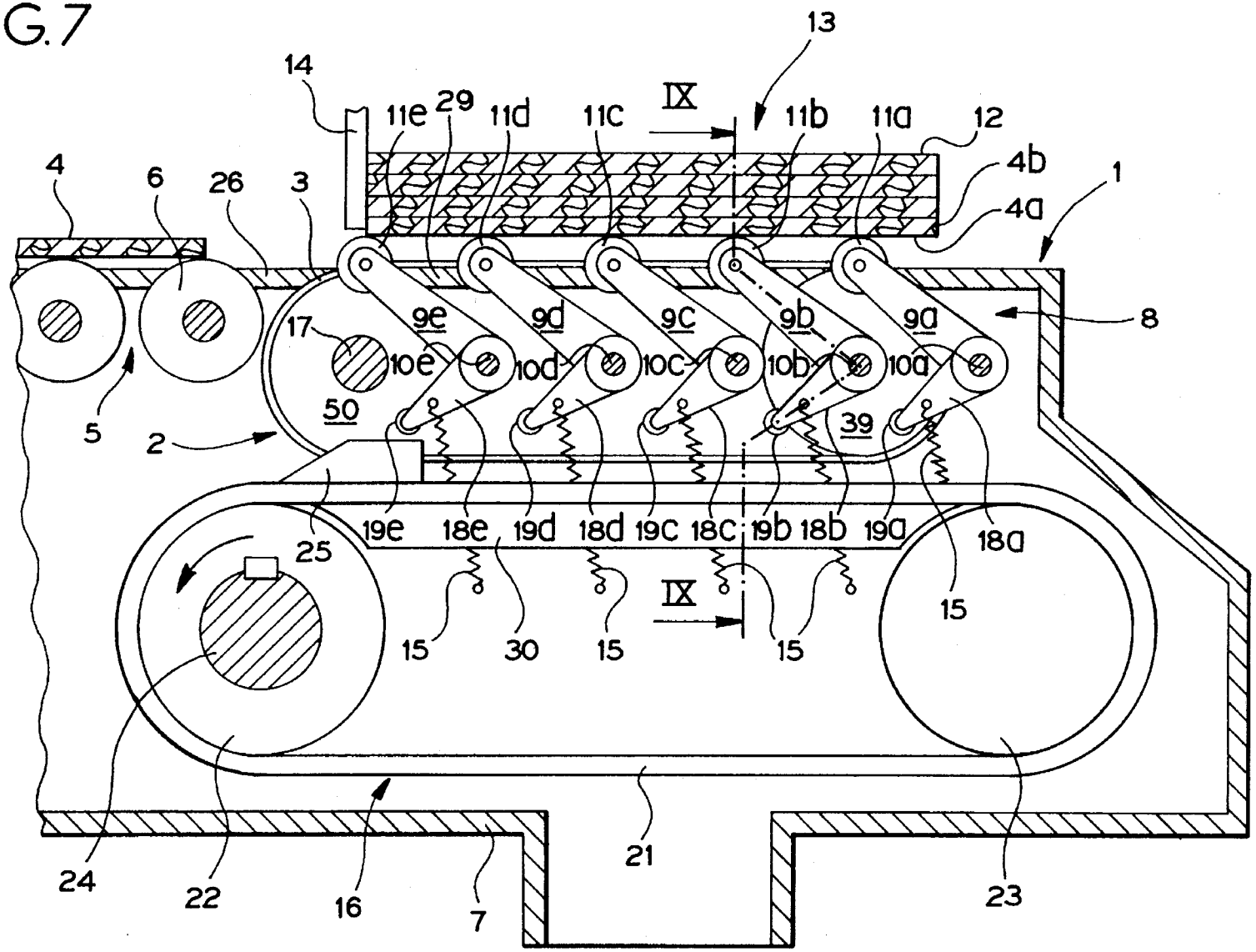
FIG. 7 is a partial sectional view of a first embodiment of the apparatus of the present invention.

FIG. 7 illustrates an embodiment of the sheet feeding apparatus 1. The holder 13, configured to receive a stack 12 of sheets, is disposed above the first carrier 2. The carrier 2 has a plurality of endless belts 3. The belts 3 are arranged adjacently, but separated from each other, in approximately the width of the apparatus 1.

In FIG. 7, as in FIG. 1, the stack 12 is supported by the rollers 11*a*–11*e*, so that the lowermost sheet 4*a* is not in contact with the belt 3. Each belt 3 is disposed around a driving pulley 50 and an idler pulley 39. Each idler pulley 39 is rotatably mounted on the second shaft 10*b*. The driving pulleys 50 are powered by a shaft 17.

Each belt 3 is preferably notched to the driving pulley 50 to prevent slippage. Also, each belt 3 is preferably constructed or covered with a material which has high frictional characteristics against the sheets 4. High friction between the belt 3 and the lowermost sheet 4*a* is desirable for precise positioning and timing during a sheet dispensing operation.

The stack supporting levers 9*a*–9*e* are each secured to the respective shaft 10*a*–10*e* by a key or cotter pin. Furthermore, in the embodiment shown in FIG. 7, actuating levers 18*a*–18*e* are also secured to the respective shafts 10*a*–10*e*. The stack supporting levers 9*a*–9*e* are arranged in gaps separating the multiple belts 3 of the first carrier 2 as shown in FIG. 7. The multiple stack supporting levers 9*a*–9*e*, and associated respective stack supporting rollers 11*a*–11*e*, are arranged to span roughly the width of the apparatus 1.

One end of each lever 18*a*–18*e* is secured to the respective shaft 10*a*–10*e*, while the other end of each lever 18*a*–18*e* has an actuating roller 19*a*–19*e*. (see FIG. 7). The actuating rollers 19*a*–19*e* are configured to be operable with a stack support actuator 16. Also, the actuating levers 18*a*–18*e* are each biased with a spring 15 which pulls its respective lever toward the actuator 16.

The actuator 16 includes, for each series of actuating rollers 19*a*–19*e*, an associated belt 21 passing around a driving pulley 22 and an idler pulley 23. The driving pulley 22 is keyed to a rotary shaft 24 which rotates in phase with the shaft 17 of the first carrier 2. This arrangement imparts motion to the stack supporting means 8 which is synchronized to the moving position of the trailing edge 4*b* of a sheet.

Preferably, the belt 21 of the support actuator 16 is a notched belt. A driving shoe 25 is secured to the belt 21. The driving shoe 25 has a ramped shape and is positioned to engage the actuating rollers 19*a*–19*e* upon movement thereunder, causing upward actuation of each actuating roller 19*a*–19*e*. The endless belt 21 of the support actuator 16 is maintained in a flat course of travel by a slide 30 disposed opposite the driving shoe 25. Alternatively, notched rollers (not shown) could be provided in lieu of the slide 30.

FIG. 7 also illustrates the vacuum housing 7 disposed generally around the first and second carriers 2, 5. The upper side 26 of the vacuum housing 7 is provided with apertures (see FIGS. 7 and 9) within which are disposed the belts 3, rollers 6, and rollers 11*a*–11*e*. Air is pulled downward through these apertures, in order to provide a downward force against each dispensed sheet 4.

In an embodiment, the second carrier 5 is positioned outside of the vacuum housing 7. Furthermore, in an embodiment, the second carrier can consist of rollers or grippers of the same type known for use in printing machines or board converting machines.

Each belt 3 is supported along the interior of its upper path of travel by a slide 29 or by multiple rollers (not shown). The design of the apertures can be varied to control the suction and consumption of air pulled through the vacuum housing 7.

Figure 8:
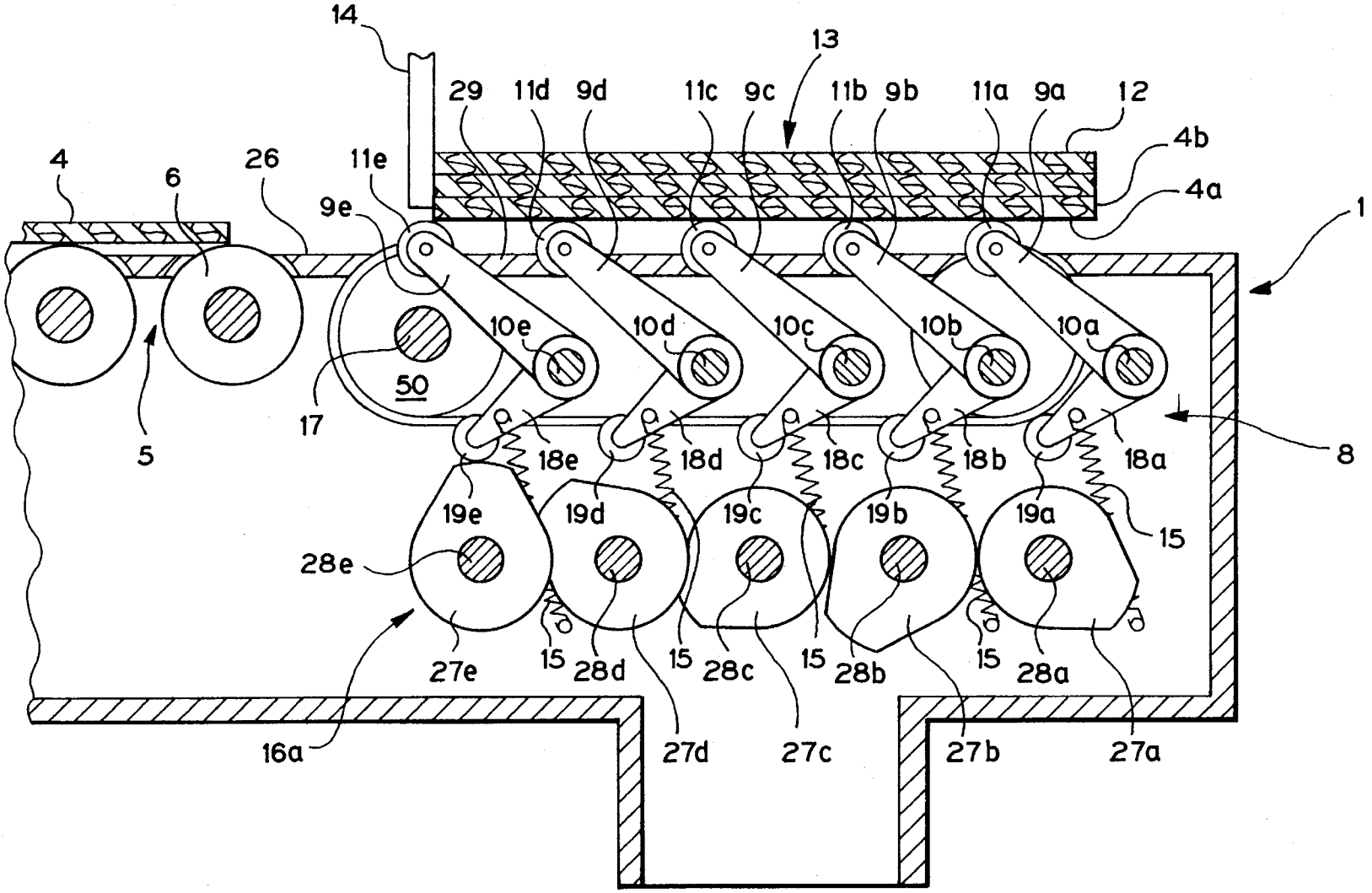
FIG. 8 is a partial sectional view of a second or another embodiment of the apparatus of the present invention.

FIG. 8 illustrates an alternative embodiment having an alternative support actuator 16*a*. In this embodiment, multiple cams 27*a*–27*e* are rotatably arranged to provide an upward actuation to respective actuation rollers 19*a*–19*e*. Each cam 27*a*–27*e* is secured to a respective shaft 28*a*–28*e*. The rotation of the shafts 28*a*–28*e* is driven by a conventional gear train (not shown) so that the stack supporting means 8 is synchronized with the traveling position of the trailing edge 4*b* of a sheet being fed.

Figure 9:
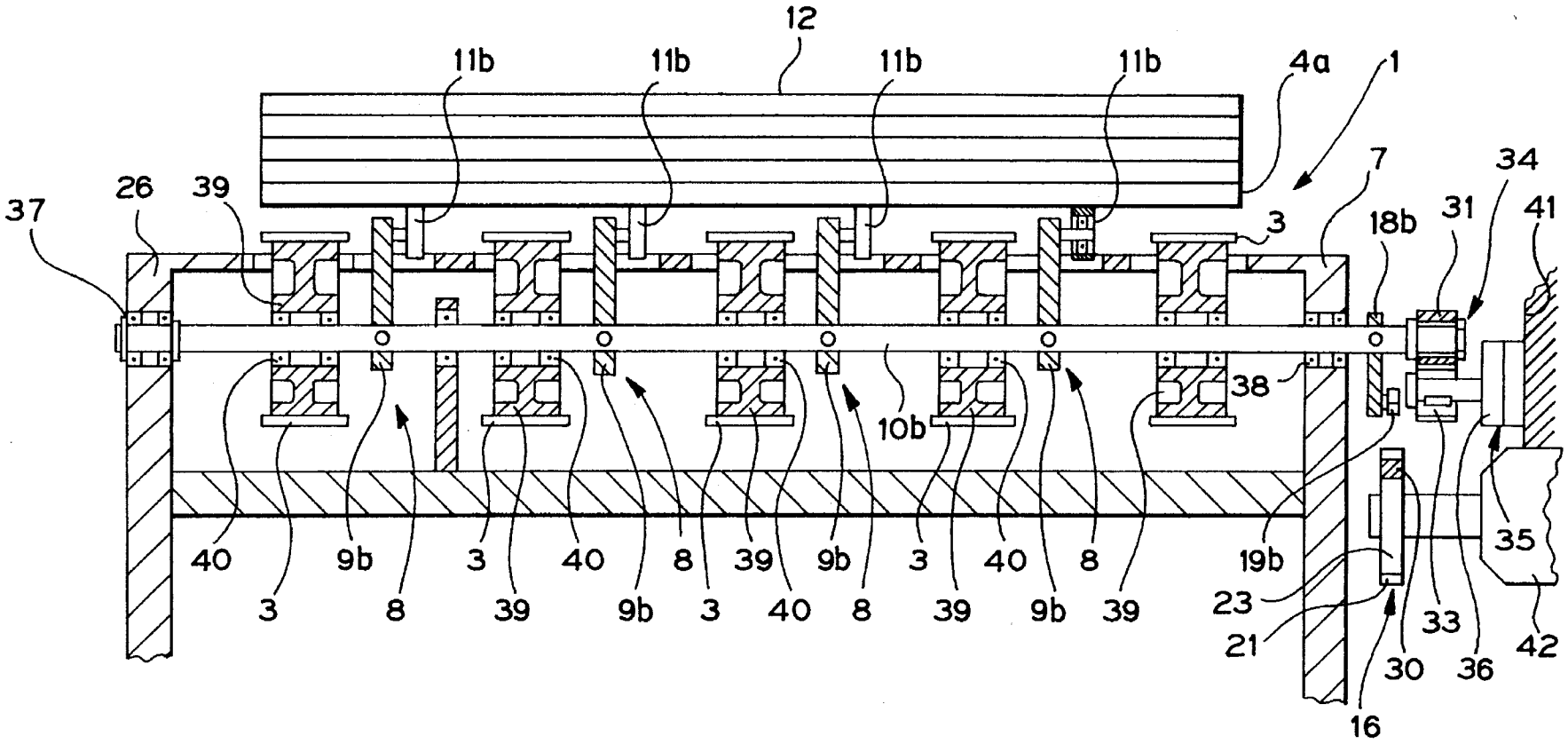
FIG. 9 is a partial front sectional view taken generally along is a side elevational view of IX—IX of FIG. 7.

In FIG. 9, the multiple series of belts 3 are provided. Accordingly, between the belts 3, are provided multiple series of stack supporting rollers 11*a*–11*e* and the respective stack support levers 9*a*–9*e*. All levers 9*a* are mounted on a single shaft 10*a*; all stack support levers 9*b* are secured to a single shaft 10*b*, etc. FIG. 9 corresponds to the stage of operation illustrated in FIG. 1, however only the series of rollers 11*b* is shown.

Figure 10:
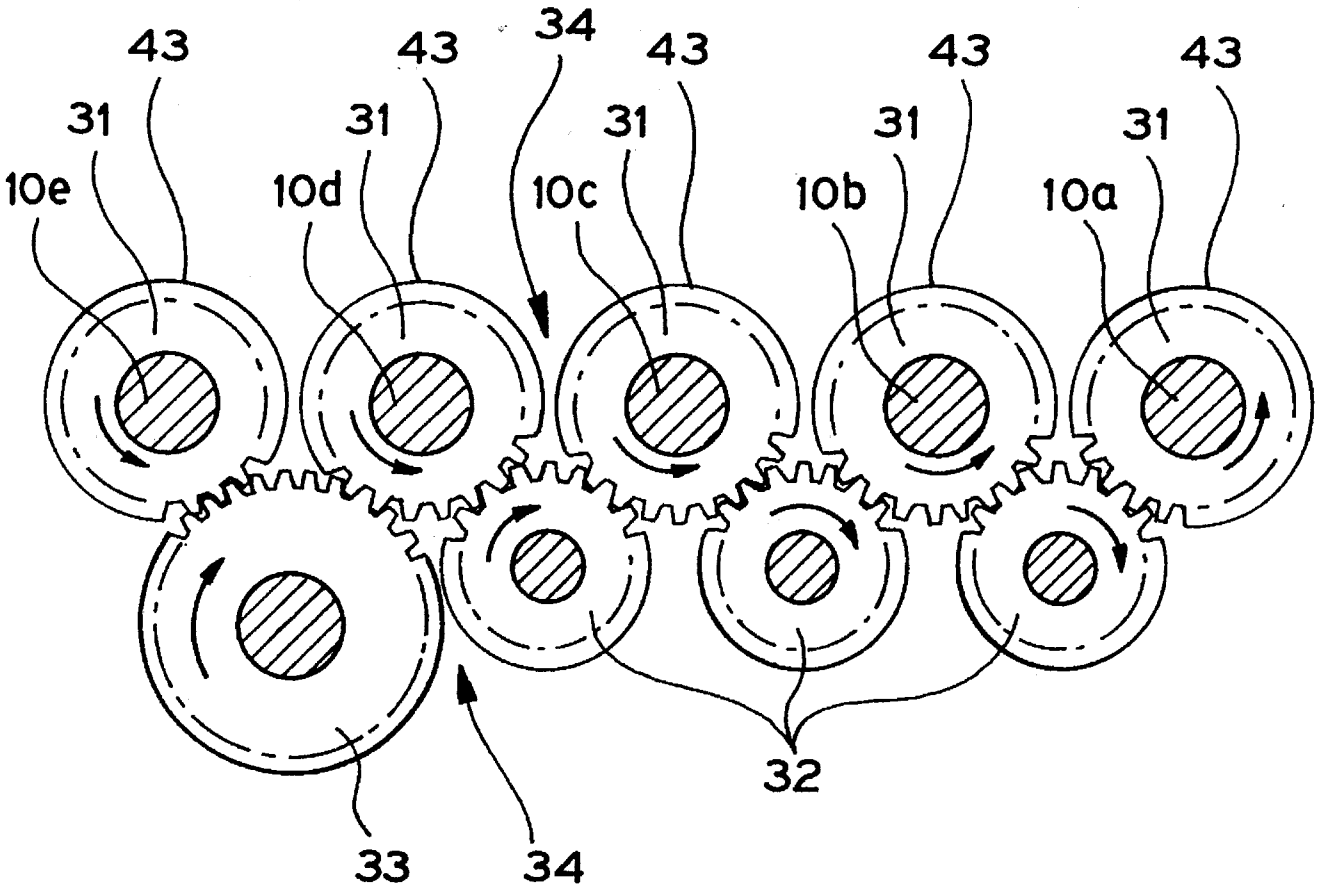
FIG. 10 illustrates the gear linkage between the blank shafts and the interlocking device of the present invention.

A locking device 34 operates at one end of every oscillating shaft 10*a*–10*e* to retain the upward position of the rollers 11*a*–11*e* temporarily after actuation by the driving shoe 25 (FIG. 7). Illustrated in greater detail in FIG. 10, each locking device 34 includes a unidirectional wheel or one way clutch wheel 31 mounted in a gear 43, which engages a series of pinions 32 forming a gear train. Engaged with the gears is a driving pinion 33 which is driven by a locking actuator 35 and is releasable by an electro-magnetic clutch 36.

A FIG. 9 illustrates, each oscillating shaft 10*a*–10*b* is rotatably mounted in bearings 37 and 38, in the walls of the vacuum housing 7. The idler pulleys 39 are also rotatably mounted on ball bearings 40 along the shaft 10*b*. However, no pulleys are mounted on shafts 10*a*, 10*c*, 10*d* and 10*e*. The stack support levers 9*b* are cottered onto the oscillating shaft 10*b*. Similarly, the other levers 9*a*, 9*c*, 9*d* and 9*e* are keyed or cottered to their respective shafts 10*a*, 10*c*, 10*d* and 10*e*.

An oscillating motion of each shaft 10*a*–10*e* is actuated by a support actuator 16 at the right moment. The electromagnetic clutch 36 is secured to a frame 41 of the apparatus 1. The notched belt 21 of the support actuator 16 is preferably driven by a motor 42. However, in an embodiment, the notched belt 21 is driven from a gearbox (not shown) coupled to a drive controller (not shown) which operates the first carrier 2 so that the two drive actions are in phase with each other.

The locking device 34 temporarily maintains an upward position of the levers 18*a*–18*e* by means of the wheels 31 after each respective lever 18*a*–18*e* has been actuated by the driving shoe 25 or by a respective cam 27*a*–27*e*. The electro-magnetic clutch 36 is locked and prevents the driving pinion 33 from rotating until the length of an entire sheet 4*a* being fed has traveled clear of the forwardmost stack support roller 11*e*. At this point, the first carrier 2 is caused to slow down. A command used for slowing the first carrier 2 is also used to release the electro-magnetic clutch 36 so that the stack 12 is dropped when the first carrier 2 has reached zero speed. A signal from a deceleration sensor or switch is used to properly position and operate the actuator 16, 16*a* in synchronous phase with the first carrier 2.

Releasing the electro-magnetic clutch 36 allows all the levers 18*a*–18*e* to return to their normal downward or retracted positions, as biased by the springs 15 (see FIGS. 7 and 8). Consequently, the rollers 11*a*–11*e* are moved downward, lowering the stack as illustrated in FIG. 2.

In an alternative embodiment, the locking device 34 could be a mechanical structure including a ratchet wherein the release action is caused by the slowing of the first carrier 2 to zero speed.

Referring back to FIG. 10, one embodiment is illustrated for linking the shafts 10*a*–10*e* and the locking device 34. The unidirectional wheels 31 are fitted inside gears 43, which are engaged by the pinions 32, 33. When the clutch 36 is engaged, the gears 43 are held fixed, but the shafts 10*a*–10*e* are independently rotated in sequence when actuated in the direction permitted by the unidirectional wheels. Each unidirectional wheel 31 is prevented from rotating in the opposite direction within its associated gear 43 so that each respective shaft 10*a*–10*e* is held in its actuated position. The shafts 10–10*b* are then rotated simultaneously to cause a downward movement of the stack by releasing the clutch 36.

It should be understood that various changes and modifications to the presently preferred embodiments described herein will be apparent to those skilled in the art. Such changes and modifications may be made without departing from the spirit and scope of the present invention and without diminishing its intended advantages. It is, therefore, intended that such changes modifications be covered by the appended claims.

What is claimed is:

1. A method of feeding a sheet from a stack comprising the steps of:

supporting said stack on a plurality of rows of rollers;

lowering said rollers so that a lowermost sheet of said stack contacts a first carrier;

driving said first carrier to accelerate said lowermost sheet in a direction perpendicular to said rows so that said sheet achieves a linear velocity;

driving a second carrier at a constant speed to transport said sheet away from said first carrier at said linear velocity; and sequentially raising each row of rollers when a trailing edge of said sheet has moved beyond each said row.

2. A method according to claim 1 wherein the step of driving said first carrier includes slowing said first carrier to correspond to zero linear sheet velocity.

3. A method according to claim 1 wherein the step of driving the first carrier includes driving said carrier in a repeating cycle from a corresponding linear speed of zero to said corresponding linear speed and back to zero.

4. A method according to claim 1 further comprising the steps of:

engaging a locking device for temporarily retaining a sequentially raised position of each said row of rollers; and disengaging said locking device.

5. An apparatus for feeding a sheet from a stack of said sheets comprising:

a first carrier being positioned under said stack for transporting said sheet in a direction, said first carrier being driveable at variable speeds;

a second carrier positioned to receive a sheet from said first carrier and transporting said sheet at a constant speed;

a plurality of rows of rollers being positioned at the first carrier and being operable to raise and lower said stack onto said first carrier, said rows being arranged transversely to said direction; and a means for raising and lowering said rows of rollers so that each said row of rollers is sequentially raised to support said stack when a trailing edge of said sheet moves beyond each said row of rollers.

6. An apparatus according to claim 5 wherein said means for raising and lowering comprises:

a plurality of support levers, each said support lever having at least one said rollers mounted thereon; and a plurality of shafts on which said support levers are mounted so that one shaft is associated with each row of rollers.

7. An apparatus according to claim 6 wherein said means for raising and lowering further comprises:

a rotatable endless belt;

a ramped shoe secured to said belt; and a separate actuation lever being operably connected to each row of rollers;

wherein said shoe contacts each actuation lever to cause an upward movement of said rollers.

8. An apparatus according to claim 6 wherein said means for raising and lowering further comprises:

a separate rotatable cam associated with each said row of rollers;

a follower lever operably connected to each shaft and following an associated cam therewith.

9. An apparatus according to claim 5 wherein said first carrier comprises at least one endless belt.

10. An apparatus according to claim 5 wherein said first carrier comprises:

a plurality of side-by-side endless belts;

a drive pulley associated with each belt; and an idler pulley associated with each belt;

wherein said rollers are positioned to raise and lower between said belts.

11. An apparatus for feeding sheets from a stack comprising:

a first carrier driveable at variable speeds in a cycle to accelerate a sheet from zero linear velocity to a linear velocity;

a holder for containing said stack having a front gate which is vertically adjustable relative to said first carrier to allow passage of a lowermost sheet of the stack;

a vacuum housing to effect a vacuum pressure downward through said first carrier;

a second carrier adjacent to said first carrier to receive a sheet therefrom, said second carrier operable at a constant speed to transport said sheet at said linear velocity; and a stack supporting means comprising:

a plurality of rotatable shafts;

a plurality of support levers secured along each said shaft;

a support roller rotatably mounted on each support lever, so that a row of said rollers is associated with each said shaft;

an actuator for rotating each shaft from a normal position to a support position in which said associated rollers are positioned to hold said stack away from said first carrier, said actuator operating in phase with a travelling motion of a trailing edge of the sheet so that each said shaft is sequentially rotated to said support position when said trailing edge is clear of said row;

a biasing means for retracting said rollers to the normal position out of contact with said stack;

a locking device associated with each said shaft for temporarily maintaining said shaft in the support position.

12. An apparatus according to claim 11 wherein said actuator comprises:

a continuous belt;

a ramped shoe secured to said belt, said shoe engaging an actuating lever secured to each shaft to rotate said shaft to said support position as the shoe moves thereby.

13. An apparatus according to claim 11 wherein said biasing means is a spring.

14. An apparatus according to claim 11 wherein said actuator comprises a plurality of cams, each cam being rotatable to engage an actuating lever secured to each shaft.

15. An apparatus according to claim 11 wherein said locking device comprises:

a gear associated with each shaft;

a unidirectional wheel within each gear secured to each shaft;

a plurality of pinions operably arranged between said gears; and means for engaging one pinion to prevent rotation thereof.

16. An apparatus according to claim 11 wherein said stack supporting means lowers said stack when said first carrier approximately reaches zero linear speed.

* * * * *